US005139860A

United States Patent [19]

Mori

[11] Patent Number: 5,139,860

[45] Date of Patent: Aug. 18, 1992

[54] RESIN-PROCESSED THIN PAPER FOR HEAT-SENSITIVE STENCIL PRINTING PAPER

[75] Inventor: Taketoshi Mori, Nobeoka, Japan

[73] Assignee: Asahi Kasei Kogyo Kabushiki Kaisha, Japan

[21] Appl. No.: 689,068

[22] PCT Filed: Oct. 27, 1989

[86] PCT No.: PCT/JP89/01112

§ 371 Date: Jun. 17, 1991

§ 102(e) Date: Jun. 17, 1991

[87] PCT Pub. No.: WO91/06434

PCT Pub. Date: May 16, 1991

[30] Foreign Application Priority Data

Apr. 23, 1988 [JP] Japan ..... 63-99323

[51] Int. Cl.[5] ..... B41M 5/00; B41N 124/00

[52] U.S. Cl. ..... 428/264; 428/137; 428/211; 428/262; 428/290; 428/335; 428/336; 428/341; 428/342; 428/359; 428/360; 428/361; 428/413; 428/423.1; 428/537.5; 428/913

[58] Field of Search ..... 428/195, 262, 306.6, 428/332, 480, 412, 360, 361, 290, 211, 359, 137, 335, 336, 340, 341, 342, 413, 423.1, 537.5, 913

[56] References Cited

U.S. PATENT DOCUMENTS 4,981,746 1/1991 Matsuo et al. ..... 428/195

FOREIGN PATENT DOCUMENTS 59-2896 1/1984 Japan .
60-259700 12/1985 Japan .
61-254396 11/1986 Japan .
62-181374 8/1987 Japan .

*Primary Examiner*—Bruce H. Hess
*Assistant Examiner*—W. Krynski
*Attorney, Agent, or Firm*—Finnegan, Henderson, Farabow, Garrett & Dunner

[57] ABSTRACT

A thin paper, which has a basis weight of 5 to 15 g/m$^2$ and a thickness of 10 to 50 μm and which comprises at least 10% by weight, based on paper-constituting fibers, of a drawn polyester fiber having a single filament fineness of 2.5 denier or less, a filament length of 15 mm or less and a birefringence (Δn) of at least 0.03. This thin paper comprises at least one member selected from the group consisting of urethane resins and epoxy resins at crossing points and surfaces of the filaments in an amount of 3 g/m$^2$ or less of the thin paper. This thin paper is a valuable as a heat-sensitive stencil printing paper.

4 Claims, No Drawings

RESIN-PROCESSED THIN PAPER FOR HEAT-SENSITIVE STENCIL PRINTING PAPER

TECHNICAL FIELD

The present invention relates to a thin paper for a heat-sensitive stencil printing paper. More particularly, the present invention relates to a thin paper to be used as a porous support of a heat-sensitive stencil printing paper which is perforated and formed into a printing plate on receipt of heat from a thermal head or a xenon flash lamp.

BACKGROUND ART

As the porous thin paper used for a heat-sensitive stencil printing paper, there are generally known (1) a Japanese paper formed from a natural fiber such as paper mulberry, paper bush or manila hemp (Japanese Examined Patent Publication No. 41-7623), (2) a paper formed from a regenerated cellulose fiber or synthetic fiber such as rayon, vinylon, polyester or nylon, (3) a mixed paper from a mixture of the above-mentioned natural fiber and the above-mentioned regenerated cellulose fiber or synthetic fiber (Japanese Examined Patent Publication No. 49-18728), and (4) a polyester paper obtained by hot-pressing by a hot rot roll a thin paper formed from a mixture of a polyester fiber and an undrawn polyester fiber as a binder fiber (Japanese Examined Patent Publication No. 49-8809).

These thin papers are defective in that they are deformed by changes in the humidity and temperature to cause a change of the dimension or reduce the capabilities thereof. Accordingly, a method in which the change of the dimension in the wet state is reduced (Japanese Unexamined Patent Publication No. 61-254396) and a method in which a thin paper is impregnated with a liquid of a synthetic resin and is treated with the synthetic resin also acting as an adhesive for the thin paper and a film (Japanese Examined Patent Publication No. 55-47997) have been proposed. Furthermore, a method of forming a polyester paper having an excellent dimensional stability and heat resistance has been proposed (Japanese Unexamined Patent Publication No. 58-76597 and Japanese Unexamined Patent Publication No. 58-76598).

The thin paper to be used for a heat-sensitive stencil printing paper must have certain capabilities: i.e., (a) the ink permeability is good and the formed image is sharp, and the image capability is excellent, (b) the printing durability is excellent, (c) the paper strength is excellent and a falling of filaments is controlled, (d) little deformation such as thermal shrinkage or a formation of wrinkles occurs and printing can be an exact reproduction of an original.

None of the foregoing known thin papers, however, satisfies all of these requirements.

The problems involved in the conventional thin papers are summarized below.

The thin paper (1) using a natural fiber is unsatisfactory in that, although a dispersant or a tackifier is added at the paper-making step, "Japanese paper crush marks" based on an uneven dispersion of the fiber inhibit a permeation of an ink and defects or omissions appear in the formed image. Although a paper strength-increasing agent is generally added at the paper-making step, the paper strength is too low, and thus the base paper is wrinkled and the printing durability is poor.

In the case of the paper (2) formed from a regenerated cellulose fiber or the paper (3) formed from a mixture of a synthetic fiber and a natural fiber, the dispersion uniformity of the fiber is improved, but since the fixation of crossing points of the fiber is poor and the paper strength is low, deformation readily occurs and a falling of filaments is caused at the laminating or printing step, with the result that the image and the printing durability are poor. According to the method disclosed in Japanese Unexamined Patent Publication No. 61-254396, the dimensional stability in the wet state is improved by incorporating a polyester fiber or a regenerated cellulose staple fiber and adding an epoxidized polyamide-polyamine resin at the paper-making step. Nevertheless, this method is still unsatisfactory in that the fixation of crossing points of the fiber is poor and the printing durability and image are not satisfactory.

In the case of the thin paper (4) comprising a polyester paper, although the preparation process is contrived so that polyester filaments are tightly bonded to one another, many crossing portions of filaments are not bonded by the binder fiber and the fixation is poor. Furthermore, the thermal shrinkage caused by heat from a thermal head or the like is large, and because of a deformation or wrinkling, the printing of an exact reproduction of the original is impossible. Moreover, the bonding between the heat-sensitive film and thin paper at the laminating step is poor, and a problem arises of a partial peeling of the film, and as a result, the image and printing durability are poor.

According to the method of the synthetic resin processing disclosed in Japanese Examined Patent Publication No. 55-47997, a resin having a relatively low softening point is used for exerting the function of the adhesive between the thin paper and the film, and therefore, it cannot be considered that crossing points of the filaments are bonded with a strong resin having a heat resistance. Namely, since a softening of the resin occurs and the reinforcing effect is poor, the paper strength and printing durability are not satisfactory.

DISCLOSURE OF INVENTION

The present inventors carried out investigations with a view to overcoming the above-mentioned defects of the conventional thin papers to be used for heat-sensitive stencil printing papers, and as a result, found that, by adding a specific resin to a thin paper comprising a polyester fiber drawn in a quantity exceeding a certain specific level after the paper-forming step, crossing points of the filaments can be bonded unexpectedly tightly and substantially uniformly without a reduction of the permeation of an ink, i.e., the requirements for a thin paper for a heat-sensitive stencil printing paper are satisfied.

In accordance with the present invention, there is provided a thin paper for a heat-sensitive stencil printing paper, which has a basis weight of 5 to 15 $g/m^2$ and a thickness of 10 to 50 $\mu m$ and which comprises at least 10% by weight, based on paper-constituting fibers, of a drawn polyester fiber having a single filament fineness of 2.5 denier or less, a filament length of 15 mm or less and a birefringence ($\Delta n$) of at least 0.03, wherein at least one member selected from the group consisting of urethane resins and epoxy resins is present at crossing points and surfaces of the filaments in an amount of 3 $g/m^2$ or less of the thin paper.

BEST MODE OF CARRYING OUT THE INVENTION

As the polyesters constituting the thin paper, preferably a polyalkylene terephthalate, more preferably polyethylene terephthalate, is used. A copolyester in which a part of the acid component or diol component is substituted with another component can be used. Furthermore, a polyester fiber having the surface treated with an antistatic agent or a dispersant or a polyester fiber having a film of a different resin film formed on the surface thereof can be used.

In the thin paper of the present invention, a drawn polyester fiber having a single filament fineness 2.5 denier or less, a fiber length of 15 mm or less and a birefringence ($\Delta n$) of at least 0.03 must occupy at least a part of the constituent fibers. When the single filament fineness of the drawn polyester fiber is larger than 2.5 denier, a uniform ink permeability cannot be obtained. The single filament fineness of the drawn polyester fiber is preferably 0.2 to 1.0 denier. When the fiber length is larger than 15 mm, the dispersion of the fiber is bad and the image is poor. The fiber length is preferably 3 to 8 mm. When the birefringence ($\Delta n$) is smaller than 0.03, the drawing of the fiber is insufficient and the thermal shrinkage becomes extremely large, deformation and wrinkling occur, and an image which is an exact reproduction of an original cannot be obtained. The birefringence ($\Delta n$) is preferably 0.07 to 0.20.

The above-mentioned drawn polyester must be incorporated in an amount of at least 10% by weight, into the constituent fibers, and the paper-making operation then carried out. When the amount of the polyester fiber is smaller than 10% by weight, even if a urethane resin or an epoxy resin is added after the paper-making operation, an unexpectedly high paper strength cannot be obtained, a uniform dispersibility of the fibers cannot be attained, and a good texture having a reduced number of fiber bonds cannot be obtained. Furthermore, the image is poor. The amount incorporated of the drawn polyester fiber is preferably 20 to 100% by weight.

Where the thin paper is composed solely of the polyester fiber or fibers, to maintain in the thin paper a strength sufficient to resist the paper-making and winding operations, preferably at least 10% by weight, especially 20 to 40% by weight, of the polyester fiber is a polyester fiber containing a resin component having a melting point of 80 to 150° C. As the polyester fiber containing a resin component having a melting point of 80 to 150° C., preferably a core-sheath fiber comprising a polyester fiber is used as the core and a low-melting-point component (having a melting point of 80° to 150° C.), especially a polyolefin or a copolyester, is used as the sheath. Furthermore, an undrawn polyester fiber having a low melting point can be used as the binder fiber in combination with the polyester fiber.

As the thin paper-constituting fiber other than the polyester fiber, there can be mentioned customarily used bast fibers and/or regenerated cellulose fibers. Preferably, natural bast fibers such as manila hemp and flax, and regenerated cellulose fibers such as viscose process rayon fibers and cuprammonium process rayon fibers are used. In view of the dispersibility of the fiber and the bonding by entanglement, preferably the single filament fineness of the regenerated cellulose fiber is smaller than 2.5 denier and the fiber length is smaller than 15 mm.

The thin paper must have a basis weight of 5 to 15 g/m$^2$ and a thickness of 10 to 50 $\mu$m. When the basis weight is smaller than 5 g/m$^2$ or the thickness is smaller than 10 $\mu$m, the printing durability becomes extremely poor, and when the thin paper is set to a printing machine as the heat-sensitive stencil printing paper, the rigidity and nerve are too low and the thin paper cannot be practically used. When the basis weight is larger than 15 g/m$^2$ or the thickness is larger than 50 $\mu$m, the ink permeability becomes far too low and the image becomes poor, and thus good results cannot be obtained. Preferably, the basis weight is 8 to 13 g/m$^2$, the thickness is 25 to 35 $\mu$m, and the density (base weight/thickness) is 0.25 to 0.45 g/cm$^3$. When the basis weight, thickness and density are within the above-mentioned ranges, the formed image is especially sharp and the image is very good.

When making the thin paper of the present invention, customarily used dispersants and tackifiers (preferably, polyethylene oxide and polyacrylamide), deforming agents, releasing agents, antistatic agents, paper strength-increasing agents at the paper-making agents and sizing agents can be incorporated.

The thin paper of the present invention retains at least one member selected from a urethane resin and an epoxy resin on crossing points and surfaces of filaments in an amount of 3 g/m$^2$ (3 g of the resin per m$^2$ of the thin paper) or less. Preferably, the strength of the resin is increased by heating, to intensify a mutual bonding among filaments.

When the amount of the resin exceeds 3 g/m$^2$, apertures of the porous thin paper are covered with resin films and the ink permeability is greatly reduced and the image becomes poor, and thus good results cannot be obtained. The amount of the resin is preferably 0.2 to 2 g/m$^2$.

As the urethane resins and epoxy resins used in the present invention, there can be mentioned solvent solution type, water-soluble type and an water-dispesible type (emulsion type) resins and the like. Furthermore, there can be mentioned non-reactive type and reactive type resins (including one-liquid type and two-liquid type resins; in the case of the two-liquid type, the reaction is carried out by using a crosslinking agent and a crosslinking promoter) and the like.

Preferably, the urethane resins and epoxy resins are water-soluble type or water-dispersible type resins. Heat reaction type water-soluble resins (a catalyst may be added) or self-emulsifiable type resins (may be crosslinked in advance) are especially preferably used. In the case of the water-soluble or water-dispersible type urethane resins and epoxy resins, gumming-up is controlled at the resin processing step, and an excellent operation adaptability is attained. The tensile strengths of the urethane resins and epoxy resins used in the present invention are preferably at least 100 kg/cm$^2$, more preferably at least 300 kg/cm$^2$.

As the method of the resin processing of the thin paper, a method is preferably adopted in which the thin paper is impregnated or coated by a gravure roll with a solution or emulsion of the urethane resin and/or the epoxy resin. After the application of the resin solution or emulsion, the thin paper is dried by a hot air drier or a hot roll. The drying temperature is preferably 50° to 210° C. When a hot-pressing operation is carried out by using a hot roll simultaneously with the drying operation, the paper strength can be further improved.

In the resin processing, the concentration of the resin is very important, and preferably the resin concentration in the processing liquid is 8 to 30% by weight, although the preferred concentration differs to some extent according to the base weight of the porous thin paper and the kind of the resin. When the resin concentration exceeds 30% by weight, resin films are formed on apertures of the thin paper and the permeation of an ink is inhibited, and the image is poor. If the resin concentration is too low, in the case of an aqueous type resin, an extreme wrinkling or shrinkage occurs in the thin paper and good results cannot be obtained.

At the resin processing of the thin paper, a paper strength-increasing agent ordinarily used at the papermaking step (preferably an epoxidized polyamide-polyamine resin, an anionic polyacrylamide resin, etc.) or a sizing agent can be used in combination with the urethane resin or epoxy resin.

The mechanism of highly improving the strength of the thin paper by the urethane resin and epoxy resin in the present invention is assumed to be as follows.

(1) At the time of the application, such as impregnation or gravure coating, the solution (dispersion) of the resin is gathered at crossing points of filaments in the thin paper by the capillary phenomenon, and a sufficient amount of the resin is accumulated in crossing points of the filaments.

(2) The resin has a strong intermolecular cohesive force, and when the thin paper is heated and dried after the coating of the resin, the resin is fusion-bonded and solidified at crossing points of filaments, whereby the strength of crossing points of the filaments is improved.

(3) The resin forms a film having an excellent toughness on the surface of the fiber and can bond filaments to one another.

(4) The isocyanate group or epoxy group possessed by the resin forms a strong bond with the functional group (such as —OH group or a carboxyl group) possessed by the fiber. An especially high bonding strength is attained by the polyester fiber.

(5) When the drying temperature is elevated to a certain extent (to about 50–210° C.), in the case of the non-reactive resin, the film formed on the fiber becomes tough, and in the case of the reactive resin, the reaction is enhanced, and the strength of the resin and the bonding force to the fiber is improved (it is considered that a partial reaction occurs between the resin and fiber).

Due to the foregoing functional effects, the strength among filaments of the thin paper is increased to a high level not attainable in the conventional thin papers, and it is considered that the paper strength is improved almost to the level influenced by the strength of the fiber per se.

The various properties referred to in the present invention were determined according to the following methods.

(1) Imageability

A FIGURE of the first level of JIS having letter size squares having a side of 5 to 20 mm and circles having a diameter of 1 to 5 mm, which were smeared black, was used as the original. A polyester film having a thickness of 2 μm was laminated as the heat-sensitive film (drawn thermoplastic synthetic resin film) was dry-laminated with the thin paper of the present invention as the porous support by a dry laminator using "Byron 300" (dry-laminating adhesive supplied by Toyobo) to form a heat-sensitive stencil printing paper (hereinafter referred to as "master") (the same procedures were adopted in examples and comparative examples). Note, in Example 16, a substantially amorphous copolyester having a thickness of 1.5 μm was used as the photosensitive film.

By using the above-mentioned master and original, a printing plate was made by a digital full-automatic stencil printing machine (Risograph 007DPN) supplied by Riso Kagaku Kogyo), and the obtained prints were evaluated in the following manner.

The evaluation was carried out with the naked eye and the image was evaluated according to the following three-stage scale, ○, Δ, and x:

○: the print was as sharp as the original, and there was no line thickness unevenness in letters and no white omission found in any of parts smeared black.

x: the print was different from the original in that lines were partially broken, wrinkles were formed, line thickness unevenness was found in letters and letters were illegible, and the print could not be practically used.

Δ: the print was in the intermediate state between ○ and x, in which although lines were partially broken and line thickness unevenness was found, letters were legible, and the print could be used.

(2) Printing durability

The printing durability was evaluated based on the number of prints, according to the following three-scale stage.

The printing operation was carried out by using the printing machine described in (1) above, and the number of prints obtained before fine breaks, wrinkles and streaks were formed and it became impossible to obtain the same printability of letters, lines and black-smeared circles as in the first print, was counted.

○: 3,000 prints or more

Δ: 1,500 to less than 3,000 prints x: less than 1,500 prints (3) Paper strength

The tensile strength at break (JIS P-8113 and JIS P-8135) of the thin paper in the paper-forming direction (longitudinal direction) was determined under dry conditions and under wet conditions. At the test under dry conditions, the test piece was allowed to stand under a constant temperature (22° C.) and constant relative humidity (66%) for 24 hours. At the test under wet conditions, the test piece was dipped in water maintained at 15° C. for 20 minutes. The unit is kg/15 mm of width.

(4) Thickness

The thickness was determined according to JIS P-8118.

(5) Gas permeability

The gas permeability was determined according to JIS P-8117, except that 96 sheets of the thin paper were piled and the measurement was carried out in this state. The unit is sec/300 cc.

(6) Rigidity

One end of the test piece of thin paper having a length of 50 mm in the paper-forming direction (longitudinal direction) and a width of 15 mm was held horizontally, and the rigidity was evaluated based on the angle formed between the line connecting the free end to the fixed end and the horizontal line. The unit is ° (degree).

(7) Thermal shrinkage

Thin lines having a length of 60 mm were drawn on the test pieces (200 mm×200 mm) of the thin paper in the paper-forming direction (longitudinal direction) and the transverse direction (lateral direction). Before and after the heat treatment (200° C.×30 minutes), the length of each line was measured, and the shrinkage was determined in either the longitudinal direction or the lateral direction. Before and after the heat treatment, the test piece was allowed to stand at a constant temperature (22° C.) and constant relative humidity (66%) for 1 hour, and the thermal shrinkage then determined.

(8) Falling of filaments

An adhesive cellophane tape (Celotape supplied by Nichiban K.K.) having a width of 18 mm and a length of 30 mm was applied to the thin paper, and the adhesive tape was peeled. The evaluation was made based on the degree of falling of filaments attached to the adhesive tape.

The evaluation was effected with the naked eye according to the following three-stage scale, ○, Δ and x:

○: no substantial falling of filaments found and the image was not substantially adversely affected.

x: many filaments were attached to the surface (18 mm×30 mm) of the adhesive tape.

Δ: the state was intermediate between ○ and x, and the test piece could be barely used as the thin paper.

The present invention will now be described with reference to the following examples. Note, all of "%" in the examples are by weight.

EXAMPLES 1 to 8

(A) Manila hemp was alkali-cooked, washed with water, diluted with water to a concentration of 3% and beaten to a freeness of 18° SR (JIS P-8121) by a beater. The obtained manila hemp was mixed with a polyester fiber shown in Table 1 (the kind and characteristics are shown) uniformly at a ratio shown in "Composition of Thin Paper" in Table 3. An epoxidized polyamide-polyamine resin was homogeneously added in the form of an aqueous solution in an amount of 2% based on the manila hemp, and the mixture was formed into a thin paper having the basis weight, thickness and density shown in "Basic Properties of Thin Paper" in Table 3, by using a Cylinder Yankee.

The thin paper was dried by a Yankee drier maintained at 130° C. and wound in a roll.

(B) The wound roll of the thin paper was processed at a resin concentration shown in "Basic Conditions of Resin Processing" in Table 3 under conditions shown in "Resin for Resin Processing and Coating and Heating Conditions" in Table 2. The amount of the resin adhering to the thin paper after the processing is shown in "Resin Amount" in Table 3.

(C) The characteristics of the resin-processed thin paper obtained in (B) above are shown in Table 3.

EXAMPLE 9

The manila hemp used in Examples 1 to 8 in an amount of 60% was homogeneously mixed with 20% of a polyester fiber [PET(C)] shown in Table 1 and 20% of a viscose process rayon fiber [staple fiber (A); single filament fineness of 1.5 denier and fiber length of 5 mm] shown in Table 1, and the subsequent treatments were carried out in the same manner as described in (A) of Examples 1 to 8 to obtain a wound roll of a thin paper having characteristics shown in Table 3.

The resin processing and the determination of the characteristics were carried out in the same manner as described in (B) and (C) of Examples 1 to 8. The results are shown in Table 3.

EXAMPLES 10 to 16

Polyester fibers shown in Table 1 were homogeneously mixed in water at a mixing ratio shown in "Composition of Thin Paper" in Table 3 and the mixture was diluted with water so that the fiber concentration was 3%. An epoxidized polyamide-polyamine resin was added in an amount of 2% based on the polyester fibers in the form of an aqueous solution and a paper stock was prepared by mixing them homogeneously. The paper stock was formed into a thin paper by using a cylinder Yankee machine. The basic characteristics of the obtained thin paper are shown in Table 3.

The thin paper was dried by a Yankee drier maintained at 130° C. and simultaneously hot-pressed, and the dried thin paper was wound into a roll. The resin processing and the determination of characteristics were carried out in the same manner as described in (B) and (C) of Examples 1 to 8. The results are shown in Table 3.

COMPARATIVE EXAMPLES 1 to 3

A thin paper composed solely of the manila hemp used in Examples 1 to 8 was prepared in the same manner as described in (A) of Example 1 to 8. The resin processing was not carried out, and the characteristics were determined in the same manner as described above. The results are shown in Table 4.

COMPARATIVE EXAMPLES 4 to 6

With respect to thin papers prepared in the same manner as described in Comparative Examples 1 to 3, the resin processing and the determination of the characteristics were carried out in the same manner as described in (B) and (C) of Examples 1 to 8. The results are shown in Table 4.

COMPARATIVE EXAMPLE 7

A thin paper was prepared in the same manner as described in Example 9, except that the polyester fiber used in Example 9 was not used and the amount of the manila hemp was increased to 80%. The results are shown in Table 4.

COMPARATIVE EXAMPLE 8

A thin paper was prepared in the same manner as described in Comparative Example 7, except that a cuprammonia process rayon fiber [staple fiber (B); single filament fineness of 1 denier and fiber length of 5 mm] was used instead of the viscose process rayon fiber used in Comparative Example 7. The results are shown in Table 4.

EXAMPLE 9

With respect to the thin paper prepared in the same manner as described in Comparative Example 7, the resin processing and the determination of the characteristics were carried out in the same manner as described in (B) and (C) of Examples 1 to 8. The results are shown in Table 4.

COMPARATIVE EXAMPLES 10 to 14

The characteristics of the thin papers prepared in the same manner as described in (A) of Examples 1 to 8 were determined in the same manner as described above without performing the resin processing. The obtained results are shown in Table 4.

COMPARATIVE EXAMPLES 15 and 16

The thin paper prepared in the same manner as described in (A) of Examples 1 to 8 was dip-coated (the resin concentration in the liquid was 10%) with an acrylic resin (Voncoat R-3380 supplied by DIC) or an SBR resin (Lacstar 3307 supplied by DIC), and the coated thin paper was dried at 105° C. to effect the resin processing. The adhering amount of resin and the characteristics were determined. The results are shown in Table 4.

COMPARATIVE EXAMPLES 17 and 18

The thin paper prepared in the same manner described as described in Examples 10 to 16 was hot-pressed by a hot roll maintained at 180° C. without performing the resin processing. The results of the determination of the characteristics of the obtained paper are shown in Table 4.

TABLE 1

| Characteristics of Polymer Fibers | | | | |
|---|---|---|---|---|
| Indication Name | Single filament fineness (denier) | Fiber length (mm) | Birefringence (Δn) | Film component of Surface Layer of Polyester |
| PET(A) | 2 | 7 | ·0.13 | — |
| PET(B) | 1 | 5.5 | 0.15 | — |
| PET(C) | 2.3 | 5 | — | Modified polyester having a melting point of 110° C. (Soffit N720 supplied by Kuraray Co.) |
| PET(D) | 1.2 | 5.5 | 0.08 | Polyethylene having a melting point of 130° C. (film thickness = 2 μm) |
| PET Binder | 2.5 | 7 | — | Undrawn polyester |

PET(C), PET(D): Core-sheath fiber
PET: Polyethylene terephthalate

TABLE 2

| Resin for Resin Processing and Coating and Heating Conditions | | | | | | |
|---|---|---|---|---|---|---|
| Kind | Indication name | Maker | Trādename | Type | Coating Method | Heating Temperature at Resin Processing |
| Urethan Resin | Urethane (A) | Daiichi Kogyo Seiyaku | Superflex 100 | Aqueous emulsion | Gravure coating | 80–160° C. |
| | Urethane (B) | DIC | Crysbon A717 (Assistant NX/HN) | Ethyl acetate solution (2-liquid type) | Gravure coating | 80–140° C. |
| | Urethane (C) | DIC | Hydran AP-20 | Aqueous emulsion | Dip coating | 80–160° C. |
| | Urethan (D) | Daiichi Kogyo Seiyaku | Elastoron H-38 | Water-soluble | Dip coating | 80–200° C. |
| Epoxy Resin | Epoxy (A) | Kuboko Paint | Sun Fast: E Clear Enamel | Methylethyl ketone solution (2-liquid type) | Gravure coating | 80–140° C. |
| | Epoxy (B) | Asahi Kasei/ Sanwa Kagaku | AER661/ Sunmide#330 | Methylethyl ketone solution (2-liquid type) | Gravure coating | 80–180° C. |

TABLE 3

| Example No. | Composition of thin paper | Basic characteristics of thin paper: Basic weight ($g/m^2$) | thickness (82 m) | Density ($g/cm^2$) | Basic conditions of resin processing: Kind | Conc. (%) ($g/m^2$) | Resin Amount | Results of evaluation of characteristics: Image ability | Printing durability | Paper strength (dry) (kg/15 mm) | Paper strength (wet) (kg/15 mm) | Gas permeability (sec) | Rigidity (degree) (−) | Thermal shrinkage |
|---|---|---|---|---|---|---|---|---|---|---|---|---|---|---|
| 1 | Manila hemp 80%/ PET(A)20% | 10.0 | 31.8 | 0.314 | Urethane (A) | 10 | 1.3 | ○ | ○ | 1.07 | 0.57 | 1.0 | 6 | 0.15 |
| 2 | Manila hemp 80%/ PET(A)30% | 10.5 | 41.9 | 0.250 | Urethane (A) | 20 | 1.8 | ○ | ○ | 1.04 | 0.62 | 0.9 | 2 | 0.15 |
| 3 | Manila hemp 40%/ PET(B)60% | 10.8 | 50.0 | 0.216 | Urethane (D) | 25 | 1.7 | ○ | ○ | 1.01 | 0.61 | 0.8 | 3 | 0.14 |
| 4 | Manila hemp 80%/ PET(C)20% | 9.2 | 31.4 | 0.293 | Urethane (A) | 25 | 1.2 | ○ | ○ | 1.10 | 0.66 | 1.1 | 7 | 0.17 |
| 5 | Manila hemp 70%/ PET(D)30% | 9.7 | 32.0 | 0.303 | Urethane (C) | 8 | 1.0 | ○ | ○ | 1.21 | 0.75 | 1.1 | 6 | 0.17 |
| 6 | Manila hemp 80%/ PET(A)20% | 9.5 | 31.7 | 0.300 | Epoxy (A) | 8 | 0.9 | ○ | ○ | 1.00 | 0.58 | 1.1 | 5 | 0.20 |
| 7 | Manila hemp 80%/ PET(A)20% | 11.6 | 36.3 | 0.320 | Epoxy (A) | 8 | 0.8 | ○ | ○ | 1.18 | 0.63 | 1.2 | 3 | 0.19 |
| 8 | Manila hemp 90%/ PET(B)10% | 7.2 | 25.5 | 0.282 | Urethane (B) | 17 | 1.2 | ○ | ○ | 0.92 | 0.55 | 0.9 | 9 | 0.22 |
| 9 | Manila hemp 60%/ Staple fiber (A)20%/PET(C)20% | 12.4 | 42.6 | 0.291 | Urethane (D) | 20 | 2.5 | ○ | ○ | 1.05 | 0.67 | 1.0 | 2 | 0.20 |
| 10 | PET(A)80%/ PET binder 20% | 13.1 | 32.0 | 0.409 | Urethane (A) | 20 | 1.5 | ○ | ○ | 1.35 | 1.16 | 1.6 | 33 | 2.1 |
| 11 | PET(A)70%/ PET(C)30% | 11.2 | 29.8 | 0.376 | Urethane (D) | 25 | 0.7 | ○ | ○ | 1.31 | 1.05 | 1.3 | 32 | 1.9 |
| 12 | PET(B)85%/ PET(C)15% | 10.6 | 27.2 | 0.390 | Epoxy (A) | 10 | 1.2 | ○ | ○ | 1.12 | 1.01 | 1.3 | 32 | 1.8 |
| 13 | PET(B)60%/ PET(C)40% | 12.9 | 31.5 | 0.410 | Epoxy (B) | 10 | 1.0 | ○ | ○ | 1.30 | 1.20 | 1.4 | 34 | 1.8 |
| 14 | PET(A)70%/ PET(C)30% | 7.0 | 15.4 | 0.455 | Urethane (D) | 25 | 2.0 | ○ | ○ | 1.00 | 0.91 | 1.2 | 35 | 1.6 |
| 15 | PET(B)60%/ PET(C)40% | 14.5 | 38.1 | 0.381 | Urethane (D) | 20 | 0.5 | ○ | ○ | 1.44 | 1.27 | 1.6 | 37 | 1.5 |
| 16 | PET(B)70%/ PET(C)30% | 12.2 | 28.5 | 0.428 | Urethane (C) | 8 | 1.0 | ○ | ○ | 1.52 | 1.24 | 1.5 | 33 | 1.7 |

TABLE 4

| Comparative Example | Composition of thin paper | Basic characteristics of thin paper: Basic weight ($g/m^2$) | thickness (82 m) | Density ($g/cm^2$) | Basic conditions of resin processing: Kind | Conc (%) | Resin amount ($g/m^2$) | Results of evaluation of characteristics: Image ability | Printing durability | Paper strength (dry) (kg/15 mm) | Paper strength (wet) (kg/15 mm) | Gas permeability (sec) | Rigidity (degree) (−) | Thermal shrinkage | Falling filament |
|---|---|---|---|---|---|---|---|---|---|---|---|---|---|---|---|
| 1 | Manila hemp 100% | 7.6 | 27.2 | 0.279 | — | — | — | Δ | X | 0.31 | 0.09 | 1.0 | 26 | 0.30 | X |
| 2 | Manila hemp 100% | 8.3 | 32.3 | 0.257 | — | — | — | Δ | X | 0.24 | 0.05 | 1.0 | 30 | 0.32 | X |
| 3 | Manila hemp 100% | 10.8 | 32.6 | 0.331 | — | — | — | X | X | 0.50 | 0.19 | 1.9 | 10 | 0.30 | X |
| 4 | Manila hemp 100% | 8.9 | 30.6 | 0.291 | Urethane (A) | 25 | 1.3 | Δ | Δ | 0.53 | 0.23 | 1.0 | 18 | 0.15 | ○ |
| 5 | Manila hemp 100% | 10.8 | 38.4 | 0.281 | Epoxy (A) | 8 | 2.6 | X | Δ | 0.60 | 0.32 | 2.1 | 11 | 0.20 | ○ |
| 6 | Manila hemp 100% | 10.7 | 37.8 | 0.283 | Urethane (B) | 15 | 2.5 | X | Δ | 0.62 | 0.36 | 2.3 | 24 | 0.13 | ○ |
| 7 | Manila hemp 80%/Staple fiber(A)20% | 9.3 | 29.9 | 0.311 | — | — | — | X | X | 0.41 | 0.28 | 2.0 | 27 | 0.25 | X |
| 8 | Manila hemp 80%/Staple fiber(B)20% | 11.4 | 38.2 | 0.298 | — | — | — | X | X | 0.64 | 0.17 | 2.5 | 12 | 0.22 | X |
| 9 | Manila hemp 80%/Staple fiber(A)20% | 11.8 | 39.9 | 0.296 | Epoxy (A) | 20 | 0.5 | X | Δ | 0.69 | 0.19 | 2.2 | 13 | 0.18 | Δ |
| 10 | Manila hemp 80%/ PET(A)20% | 8.7 | 25.6 | 0.340 | — | — | — | X | X | 0.47 | 0.16 | 1.5 | 23 | 0.20 | X |
| 11 | Manila hemp 70%/ PET(A)30% | 8.6 | 29.5 | 0.292 | — | — | — | X | X | 0.17 | 0.06 | 1.2 | 24 | 0.20 | X |
| 12 | Manila hemp 40%/ PET(B)60% | 9.1 | 31.2 | 0.292 | — | — | — | X | X | 0.04 | 0.02 | 1.3 | 30 | 0.25 | X |
| 13 | Manila hemp 80%/ PET(C)20% | 9.3 | 34.0 | 0.274 | — | — | — | X | X | 0.44 | 0.18 | 1.0 | 10 | 0.18 | X |
| 14 | Manila hemp 70%/ PET(D)30% | 9.5 | 33.1 | 0.287 | — | — | — | X | X | 0.46 | 0.20 | 1.0 | 12 | 0.22 | X |
| 15 | Manila hemp 80%/ PET(A)20% | 10.2 | 37.1 | 0.275 | Acrylic resin | 10 | 2.1 | X | X | 0.59 | 0.29 | 1.3 | 17 | 0.17 | Δ |
| 16 | Manila hemp 80%/ PET(A)20% | 10.4 | 39.1 | 0.266 | SBR resin | 10 | 2.3 | X | X | 0.61 | 0.23 | 2.5 | 20 | 0.18 | Δ |
| 17 | PET(A)80%/ PET binder 20% | 12.2 | 29.7 | 0.411 | Hot pressing by hot roll (temp: 180° C.) | | | Δ | Δ | 0.63 | 0.49 | 3.0 | 37 | 4.0 | X |
| 18 | PET(A)70%/ PET(C)30% | 14.0 | 35.9 | 0.390 | | | | X | X | 0.35 | 0.21 | 2.8 | 45 | 4.5 | X |

Industrial Applicability

The thin paper of the present invention has the excellent characteristics described below, and therefore, is valuable as a heat-sensitive stencil printing base paper.

(1) The thin paper has an unexpectedly high strength as a porous support.

(2) The printing durability is high.

(3) Filaments are uniformly dispersed and the texture is very good.

(4) A sharp image having a high quality is formed at the printing step.

(5) The nerve is relatively strong and a formation of wrinkles and other defects is prevented at the printing step.

(6) Falling (dropping) of the fiber is drastically controlled.

(7) The shrinkage of a thin paper composed solely of a polyester can be reduced by a resin processing.

(8) A paper composed solely of a polyester can be simply prepared at a high yield.

I claim:

1. A thin paper for a heat-sensitive stencil printing paper, which has a basis weight of 5 to 15 g/m$^2$ and a thickness of 10 to 50 $\mu$m and which comprises at least 10% by weight, based on paper-constituting fibers, of a drawn polyester fiber having a single filament fineness of 2.5 denier or less, a filament length of 15 mm or less and a birefringence ($\Delta n$) of at least 0.03, wherein at least one member selected from the group consisting of urethane resins and epoxy resins is present at crossing points and surfaces of filaments in an amount of 3 g/m$^2$ or less of the thin paper.

2. A thin paper for a heat-sensitive stencil printing paper as set forth in claim 1, wherein the thin paper-constituting fibers are polyester fibers alone, and at least 10% by weight of the polyester fibers having on the surfaces thereof a resin component having a melting point of 80° to 150° C.

3. A thin paper for a heat-sensitive stencil printing paper as set forth in claim 1, wherein the thin paper is composed of a polyester and at least one member selected from the group consisting of a natural bast fiber and a regenerated cellulose fiber.

4. A thin paper for a heat-sensitive stencil printing paper as set forth in claim 1, 2 or 3, wherein the urethane resins and/or epoxy resins are water-soluble resins or water-dispersible resins.

* * * * *